United States Patent [19]

Pierce

[11] 4,093,228

[45] June 6, 1978

[54] WATER DUMPING TARGET GAME

[76] Inventor: Franklin K. Pierce, 14220 SW. 74th St., Miami, Fla. 33183

[21] Appl. No.: 810,416

[22] Filed: Jun. 27, 1977

[51] Int. Cl.[2] ..... F41J 7/00; F41J 5/00; A63B 71/06

[52] U.S. Cl. ..... 273/102.1 G; 273/102.1 E

[58] Field of Search ..... 273/102.1 G, 102.1 E; 272/27

[56] References Cited

U.S. PATENT DOCUMENTS

| | | | |
|---|---|---|---|
| 1,021,019 | 3/1912 | Van Kannel | 273/102.1 G |
| 1,413,770 | 4/1922 | Palaith | 273/102.1 G |
| 1,671,000 | 5/1928 | Weinstein | 273/102.1 G |
| 2,202,738 | 5/1940 | Keller | 273/102.1 G |

FOREIGN PATENT DOCUMENTS

| | | | |
|---|---|---|---|
| 597,724 | 9/1925 | France | 273/102.1 G |
| 310,271 | 10/1955 | Switzerland | 273/102.1 G |
| 323,951 | 10/1957 | Switzerland | 273/102.1 G |

OTHER PUBLICATIONS

"The Rube Goldberg Plan for the Post-War World," Rube Goldberg (Franklin Watts, Inc., N.Y., N.Y,) 1944, p. 35.

*Primary Examiner*—Richard C. Pinkham
*Assistant Examiner*—Lawrence E. Anderson
*Attorney, Agent, or Firm*—Salvatore G. Militana

[57] ABSTRACT

A water dumping toy consisting of a bucket adapted to be filled with water pivotally mounted on a standard and having a release device for tilting the bucket including a target which when made to swing upon being struck by a missile causes the release member to become disengaged causing the bucket to swing downwardly and dump the water onto the area therebelow.

3 Claims, 4 Drawing Figures

WATER DUMPING TARGET GAME

BACKGROUND OF THE INVENTION

1. Field Of The Invention

This invention is directed to a water dumping toy.

2. Description Of The Prior Art

There are presently numerous amusement apparatuses used in carnivals, circuses, etc. that utilize a target, which when struck by a missile will cause an individual to be dumped into a vat of water. These devices are large in size, complicated in the construction of the restraining and release mechanism and expensive in cost. The present invention contemplates avoiding the above objections to these devices by providing a toy for a child for dumping water upon striking a target.

SUMMARY OF THE INVENTION

Therefore, a principal object of the present invention is to provide a water dumping toy which is simple in construction and operation and inexpensive in cost.

Another object of the present invention is to provide a water dumping toy that requires a small force to actuate the release device which causes a receptacle filled with water to swing from an upright position by the force of gravity to an inverted position.

A further object of the present invention is to provide a water dumping toy that is adjustable permitting the water filled bucket to be positioned at any desired height above the platform supporting the device.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
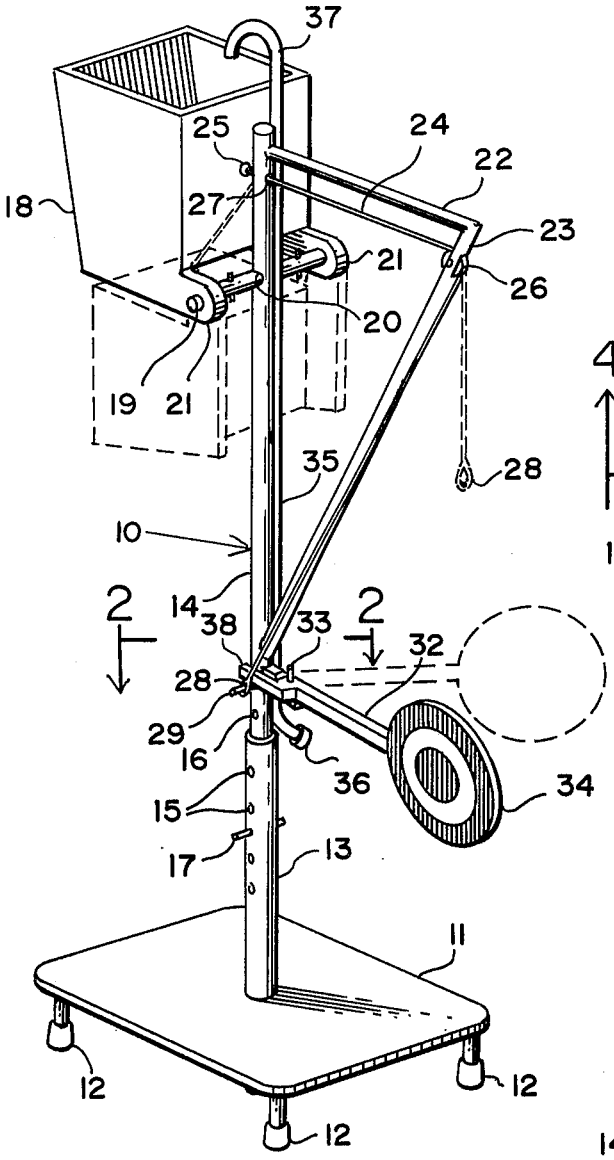
FIG. 1 is a perspective view of a water dumping toy constructed in accordance with my invention, the dotted lines showing the device in a released position.
Figure 2:
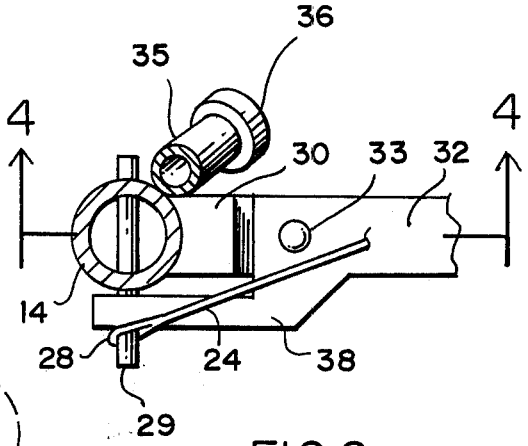
FIG. 2 is a cross sectional view taken along the line 2—2 of FIG. 1.
Figure 3:
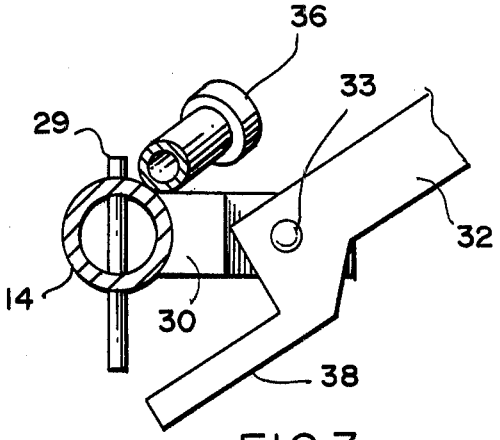
FIG. 3 is a similar view of the tripping apparatus in the released position.
Figure 4:
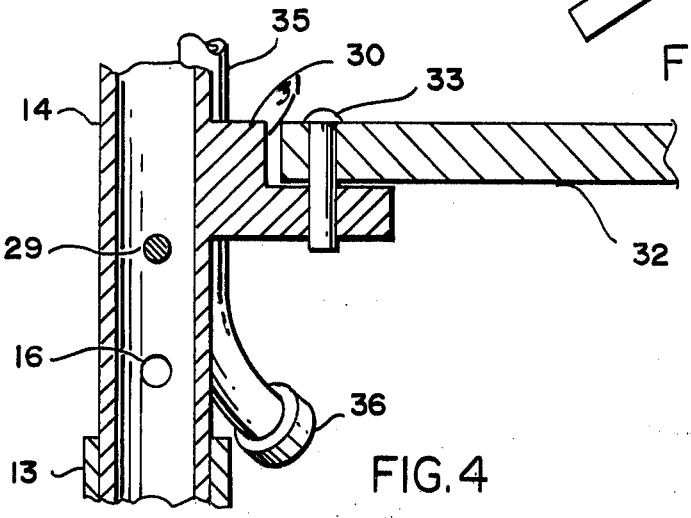
FIG. 4 is a cross sectional view taken along the line 4—4 of FIG. 2.

Referring to the drawing wherein like numerals are used to designate similar parts throughout the several views, the numeral 10 refers to a water dumping toy constructed in accordance with my invention consisting of a base member or platform 11 having a plurality of foot portions 12 for supporting my toy 10. Extending upwardly of the platform 11 is a support pipe 13 in which a second support pipe 14 is telescopically mounted. The support pipes 13 and 14 are provided with matching bores 15 and 16 for receiving a dowel 17 in adjusting the height of the toy 10.

Mounted at the top end portion of the support pipe 14 is a bucket or open top receptacle 18 for containing water. The receptacle 18 is pivotally mounted on the support pipe 14 by a shaft 19 that extends through an opening 20 in the support pipe 14 with its end portions secured to tabs 21 mounted on the lower portion of the receptacle.

Means are provided to maintain the receptacle 18 in an upright or solid line position as shown by FIG. 1 consisting of a horizontal member 22 secured at one end to the top end portion of the support pipe 14 and its other end secured to one end of a brace 23 at a distance from the support pipe 14. The other end of the brace 23 which extends diagonally is secured to the base portion of the support pipe 14. A lanyard 24 that has one end fastened to the receptacle as at 25 extends through an opening 27 in the support pipe 14, over a pulley 26 mounted on the upper end portion of the diagonal brace member 23 and terminates in a loop 28.

Mounted on the support pipe 14 and extending horizontally is a pin 29 which is adapted to receive the loop 28 of the lanyard 24 to maintain and secure the bucket or receptacle 18 in an upright position at which position the bucket 18 is filled with water and ready to be tipped.

The tipping mechanism consist of a pivot support member 30 secured to the support pipe 14 adjacent to the pin 29 and forming a lap joint as at 31 with the inner end portion of a target arm 32 being pivoted thereto by a pivot pin 33. The target arm 32 is provided with a finger portion 38 that extends inwardly to a position beyond and alongside the support pipe 14 and above the pin 29; at the free or outer end of the target arm 32 is a target 34.

Attached to and extending longitudinally along the support pipe 14 is a water supply pipe 35 having a hose connection 36 at the lower end and with its upper end bent downwardly as at 37 to form an outlet for directing the flow of water into the receptacle 18. The height of the bucket 18 above the platform 11 can readily be adjusted by removing the pin 17 and sliding the support pipe 14 with relation to the base pipe 13 to appropriate matching openings 15, 16 and then reinserting the pin 17 therethrough.

When a person is desirous of using my toy 10, he will swing the target arm 32 about the pivot pin 33 to the solid line position as shown by FIG. 1 at which position the finger portion 38 will find itself above the pin 29 as it abuts against the support pipe 14. He then pivots the bucket 18 about the shaft 19 to its upright or solid line position as he pulls on the lanyard 24 at the loop 28. He slips the loop 28 over the free end of the pin 29 to secure the bucket 18 in the upright position. Now he connects the hose connection 36 to a source of water and proceeds to fill the bucket 18 with water. The toy 10 is now ready to be played with. A person stands off at a distance from the target 34 and throws a projectile or article such as a bean bag or ball at the target 34. When he strikes the target 34, the target arm 32 will pivot about the pivot pin 33 causing the finger portion 38 to sweep the loop 28 of the lanyard 24 off the pin 29 to compel the bucket to tip by gravity about the shaft 19 to the dotted line position and spill the water on any object that had been placed therebelow.

What I claim as new and desire to secure by Letters Patent is:

1. A water dumping toy comprising a platform, support means extending upwardly of said platform, a water bucket, horizontally disposed pivot means supporting said water bucket on said support means, a lanyard, means securing an end of said lanyard to said bucket, said lanyard having a loop portion at the other end, a pin mounted on said support means receiving said loop portion and maintaining said water bucket in an upright position, a target arm, a target mounted at one end of said arm, pivot means mounting the other end of said target arm in proximity of said pin and release means mounted on said target engaging said loop whereby upon the swinging of said target about said pivot means said loop is removed from said pin and said water bucket is compelled to pivot about said horizontally disposed pivot means and dump the water in said water bucket.

2. The structure as recited by claim 1 wherein said release means comprises a finger portion extending outwardly of said target arm between said support means and said loop and above said pin whereby upon the swinging of said target arm, said finger portion sweeps said loop off said pin.

3. The structure as recited by claim 2 taken in combination with brace means connected to said support means in a direction opposite to said water bucket, a pulley mounted on said brace means and said support means having an opening, said lanyard extending through said opening and engaging said pulley.

* * * * *